US008645048B2

(12) United States Patent
Yudanov et al.

(10) Patent No.: US 8,645,048 B2
(45) Date of Patent: Feb. 4, 2014

(54) INTERNAL COMBUSTION ENGINE FOR USE WITH A PRESSURIZED LOW VISCOSITY FUEL

(75) Inventors: Sergi Yudanov, Västra Frölunda (SE); Annika Carlsson, Kungälv (SE)

(73) Assignee: Volvo Lastvagnar AB, Göteborg (SE)

( * ) Notice: Subject to any disclaimer, the term of this patent is extended or adjusted under 35 U.S.C. 154(b) by 1026 days.

(21) Appl. No.: 12/447,260

(22) PCT Filed: Oct. 26, 2006

(86) PCT No.: PCT/SE2006/001207

§ 371 (c)(1), (2), (4) Date: Nov. 20, 2009

(87) PCT Pub. No.: WO2008/051121

PCT Pub. Date: May 2, 2008

(65) Prior Publication Data

US 2011/0010080 A1 Jan. 13, 2011

(51) Int. Cl.
*F02D 41/06* (2006.01)

(52) U.S. Cl.
USPC ..... 701/113; 123/179.5

(58) Field of Classification Search
USPC ..... 701/100–105, 113; 123/179.5, 179.8, 123/179.13, 179.16, 179.18, 179.3, 182.1, 123/525, 575
See application file for complete search history.

(56) References Cited

U.S. PATENT DOCUMENTS

| | | | | | |
|---|---|---|---|---|---|
| 2,013,728 | A | * | 9/1935 | Fitz Gerald | 123/179.13 |
| 3,478,512 | A | * | 11/1969 | Brahm et al. | 60/39.281 |
| 4,193,384 | A | * | 3/1980 | Steiner et al. | 123/179.18 |
| 5,099,813 | A | | 3/1992 | Kurosu et al. | |
| 5,163,397 | A | * | 11/1992 | Pien | 123/299 |
| 5,258,651 | A | * | 11/1993 | Sherman | 290/23 |
| 5,353,759 | A | * | 10/1994 | Abe et al. | 123/179.15 |
| 5,476,073 | A | * | 12/1995 | Betts | 123/73 AD |
| 5,485,818 | A | * | 1/1996 | McCandless | 123/294 |
| 5,816,228 | A | * | 10/1998 | McCandless | 123/575 |
| 5,931,123 | A | * | 8/1999 | Firey | 123/25 C |
| 6,119,664 | A | * | 9/2000 | McCandless | 123/527 |

(Continued)

FOREIGN PATENT DOCUMENTS

| | | | |
|---|---|---|---|
| DE | 10335152 | A1 | 3/2005 |
| JP | 2000265880 | A | 9/2000 |
| JP | 2003003909 | A | 1/2003 |

OTHER PUBLICATIONS

Machine translation of DE 10335152, Feb. 10, 2012.*

(Continued)

*Primary Examiner* — John T. Kwon
*Assistant Examiner* — Johnny Hoang
(74) *Attorney, Agent, or Firm* — WRB-IP LLP

(57) ABSTRACT

An internal combustion, compression ignition engine for use with a pressurized low viscosity fuel includes an engine power cylinder with its associated gas flow path, a valve system for opening fluid communication between the engine power cylinder and the gas flow path, and an engine management system (EMS). The engine management system is adapted to provide a pre-starting mode in which an open fluid communication between the engine power cylinder and the gas flow path is established in such a manner that any fuel present inside said engine power cylinder is prevented from reaching the fuel ignition temperature for the fuel.

19 Claims, 3 Drawing Sheets

(56) References Cited

U.S. PATENT DOCUMENTS

| | | | | |
|---|---|---|---|---|
| 6,145,486 | A * | 11/2000 | Aikawa | 123/179.17 |
| 6,189,517 | B1 | 2/2001 | McCandless | |
| 7,028,657 | B2 * | 4/2006 | Sah et al. | 123/179.3 |
| 7,281,500 | B1 * | 10/2007 | Firey | 123/23 |
| 7,458,353 | B2 * | 12/2008 | Takahashi | 123/179.4 |
| 7,487,762 | B2 * | 2/2009 | Kaneko | 123/508 |
| 7,524,266 | B2 * | 4/2009 | Nobumoto et al. | 477/110 |
| 7,549,410 | B2 * | 6/2009 | Yudanov | 123/506 |
| 2004/0003781 | A1 * | 1/2004 | Yuki et al. | 123/25 C |
| 2004/0118116 | A1 * | 6/2004 | Beck et al. | 60/601 |
| 2005/0172700 | A1 * | 8/2005 | Sugiura | 73/61.48 |
| 2006/0096565 | A1 * | 5/2006 | Hattori et al. | 123/179.5 |
| 2007/0119403 | A1 * | 5/2007 | Laubender | 123/179.3 |
| 2008/0154484 | A1 * | 6/2008 | Takeyama et al. | 701/113 |

OTHER PUBLICATIONS

International Search Report for corresponding International Application PCT/SE2006/001207.

Supplementary European Search Report for corresponding European App. EP 06 81 2933.

* cited by examiner

INTERNAL COMBUSTION ENGINE FOR USE WITH A PRESSURIZED LOW VISCOSITY FUEL

The present invention relates to the field of an internal combustion, compression ignition engine for use with a pressurized low viscosity fuel, said engine comprising an engine power cylinder with its associated gas flow path, a valve system for opening fluid communication between the engine power cylinder and the gas flow path, and an engine management system (EMS). The invention also relates to a method for operating an internal combustion^compression ignition engine for use with a pressurized low viscosity fuel.

Non-fossil fuels are often used as environment friendly alternatives to common diesel fuel. Fuels with high vapour pressure, like dimethyl ether (DME), typically have very low viscosity as compared to traditional diesel fuel oil, so low that it can leak past closed nozzle valves even when the valve's sealing surface is not damaged. Moreover, the fuel injection and supply systems for such low-viscosity fuels are often designed such that the fuel pressure well above atmospheric is retained in the volumes of the fuel system even when the engine is stopped. That creates conditions for fuel leakage into the engine power cylinders even when the engine is not running and no fuel pressure for actual injection is present.

Prior art fuel injection systems have been disclosed in which dedicated means for protection against leakage through injector nozzles in a stopped engine is employed, either in the form of an electronically controlled isolating valves or automatic isolating valves. A prior art system with automatic isolating valves is disclosed, for example, in the U.S. Pat. No. 6,189,517. While known leakage protection systems are generally effective, it is still possible that they lose their functionality in use. One reason for this may be a piece of debris jammed between the sealing surfaces of a leakage protection valve. If that happens, a significant amount of fuel may leak down in an engine power cylinder. Upon trying to start the engine in which such a leakage took place, that amount of leaked fuel may ignite and cause overpressure and excessive temperature in the affected cylinder with possible subsequent damage to various engine components.

It is desirable to provide means of avoiding damage and increasing safety when starting an engine in which a volatile fuel has leaked into a power cylinder.

An aspect of the invention also concerns improvements in the engine starting and diagnostics methods and systems with the aim of increasing safety, improving reliability and reducing downtime of engines that use fuels with high vapour pressure, such as DME. It also introduces a convenient diagnostic method allowing accurate measurement of injector-to-injector fuelling uniformity whilst requiring no special test equipment or preparation work to carry out such measurement.

It is also desirable to provide a system and method for the detection of the presence of a leaked high-volatility fuel in an engine power cylinder and for a safe engine start-up in case such a leakage is detected. It is also desirable to provide such a system in which the necessary functionality is achieved with minimum cost and complexity. It is also desirable to provide a simple and accurate method of measuring the injector-to-injector uniformity of delivery of a high-volatility fuel such as DME.

The present invention offers, according to aspects thereof, the advantages of i) increasing operational safety of engine fueled with a high-volatility fuel such as DME, ii) improving reliability of such an engine, and iii) reducing maintenance costs. The safety of engine operation is increased because uncontrolled pressure and temperature rise in the engine at start-up can be prevented. The reliability is improved because the invention provides means of safe starting of an engine which otherwise would either not be possible to start or which would break down upon starting. The reliability is further enhanced by the fact that a self-cleanup of injection system is possible on a running engine because the debris that caused a failure of isolating valves can get washed away by the flow of fuel and the leakage protection function of the fuel injection system can be restored. Still further contribution to improved reliability, as well as reduced maintenance costs, can be attained by utilising the fuelling uniformity diagnostic function, that allows detection of injectors with a deviation of fuelling from its calibrated value without removing any of the components from the engine/vehicle. This method is significantly more accurate than the known method of measuring/comparing exhaust port temperatures on a running engine, because in the latter the injection pattern irregularities and combustion effects come into play and distort the picture afforded by the analysis of the cylinder-to-cylinder uniformity of exhaust gas temperatures.

BRIEF DESCRIPTION OF THE DRAWINGS

The invention will be further described in the following, in a non-limiting way with reference to the accompanying drawings, in which.

DETAILED DESCRIPTION OF THE INVENTION

Figure 1:
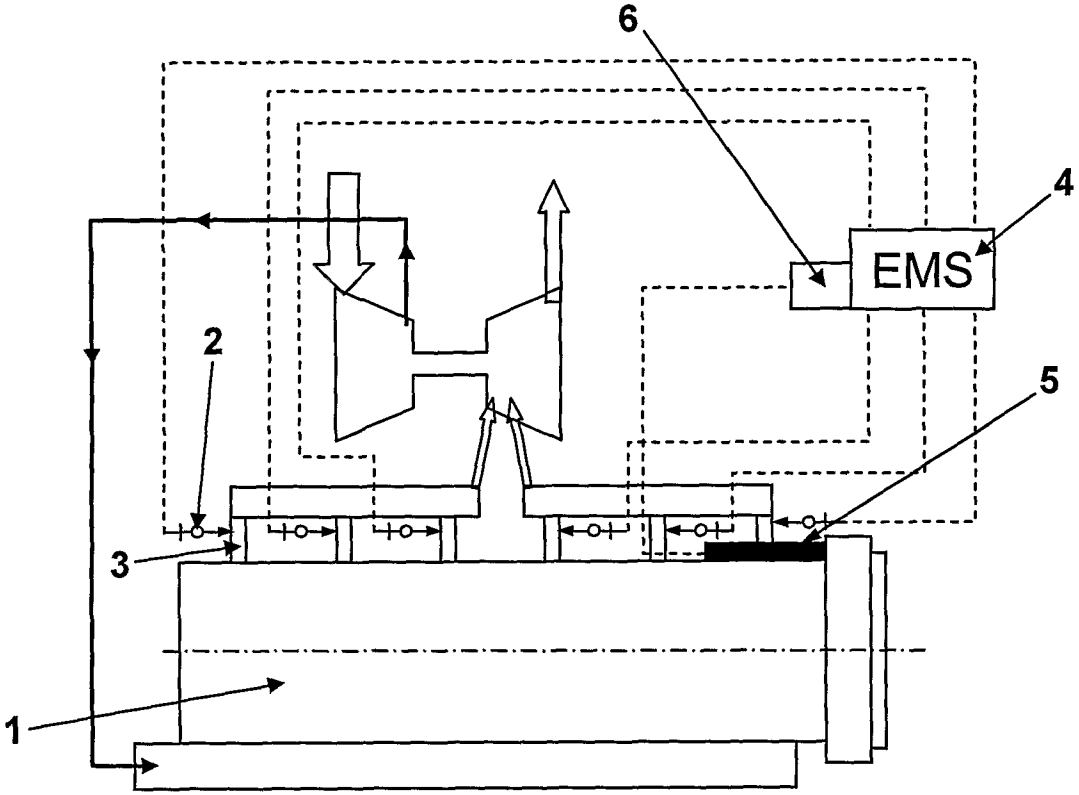
FIG. 1 shows an internal combustion engine according to a first embodiment of the invention.

In the embodiment shown in FIG. 1, an internal combustion engine 1 for use with a pressurized low viscosity fuel is equipped with a fuel system (not shown) for injection of a high-volatility fuel such as DME into the power cylinders of the engine. Temperature sensors 2 are installed in each individual exhaust port 3 of the engine, with the exhaust ports 3 representing the gas flow paths connected to each of the engine's individual power cylinders. The sensors 2 are adapted to be read by an EMS 4 that controls both the fuel injection system and the leakage detection/starting system according to present invention. The engine is further equipped with a two-speed cranking system incorporating a starter motor 5 and a starter motor controller 6.

A preferable method of leakage detection and safe startup of the engine includes the steps of 1. Activating, upon receiving the command from the driver to start the engine, the measurement of temperatures in the engine exhaust ports as facilitated by the temperature sensors 2, and storing the temperatures in the EMS memory;
2. Switching on the first engine cranking mode characterized by a relatively slow cranking speed that prevents reaching a high enough pressure in the engine power cylinders which could cause the temperature to rise to or above the fuel ignition temperature. A typical slow cranking speed can be in the order of 30 rpm. The fuel injection is preferably not turned on during this mode;
3. Analysing the temperature data with respect to its deviation from the value measured prior to cranking and to differences in temperature between separate temperature sensors;
4. Keeping the slow cranking mode on either until the measured temperature differences are below a predetermined value, in which case moving on to step 5, or until a maximum allowed slow cranking duration is reached, in which case switching everything off and reporting a fault to the driver. A typical maximum allowed slow cranking duration can be in the order of 30 seconds; and 5. Switching over to the conventional, higher cranking speed and turning the fuel injection on in order to get the engine started.

During step 2, the relatively slow cranking of the engine will still provide an air through-flow from the inlet ports into the power cylinders and then out through the exhaust ports. That flow will carry away any fuel vapour released by the fuel that may have leaked into a cylinder and collected there. The cooling effect of the vaporizing fuel is proportional to the amount of fuel, and that will be detected by the temperature sensors. During step 4, in case significant temperature differences are detected between the sensors, the slow cranking will keep pumping air through the engine and carrying fuel vapour with it out through the exhaust system. Provided that the leakage rate at that time is less than the rate of fuel vapour mass evacuation from the engine, the leaked fuel will eventually be removed from the cylinder and a safe engine start-up will become possible as per step 5. In case the leakage rate is higher than the speed of fuel evacuation from the cylinder during step 4, the equalization of measured temperatures will not be achieved and a preset time delay will govern the maximum duration of slow cranking, unless the driver decides to terminate the start-up attempt manually.

The possibility of relatively slow cranking of engine will also make it possible to perform the injector fuelling uniformity diagnostics. To achieve that, steps 1 to 4 as described above are followed, and then, when it has been verified that there is no apparent leakage in any of the cylinders, a fuel injection is turned on. The ignition of that fuel will be prevented by definition, and the cooling effect of the vaporization of the injected fuel will be commensurate with the amounts injected, allowing a conclusion about the uniformity of fuel injection to be made. That conclusion might not be too accurate, especially taking into account the different operating conditions of the fuel injection system during regular engine running as opposed to the slow cranking mode, but it should nevertheless afford an opportunity of detecting relatively serious performance degradation of an injector.

If the engine is equipped with a variable valve actuation (WA) system that, by restricting the air flow through the engine, can prevent the cylinder air temperatures from rising to a level of fuel ignition, then that could be used for measuring fuel delivery uniformity at speeds higher than the first cranking mode in order to increase the useful test range of the fuel injection system. However, the accuracy of measurement results will be subject to the capability of such a WA system to precisely control the amount of air it allows to pass through the engine (to limit peak temperatures, on one hand, and to achieve necessary flow to carry the fuel vapour past the temperature sensor, on the other).

In the first embodiment of the present invention that is being described, the first cranking mode is set up solely-through the controlled reduction of electric power applied to the starter motor 5 by the starter motor controller 6. It is known that the rotational speed of the engine crankshaft tends to not be uniform over the angle of rotation, and that the slower the cranking speed, the greater its fluctuation within a single revolution, especially during starter motor cranking. Too large fluctuations could lead to the piston in one of the engine cylinders occasionally accelerating to a speed much higher than average with correspondingly high pressure and temperature being created in the combustion chamber, which would demand further reduction of electric power supplied to the starter motor and which, in turn, means even greater speed fluctuation.

Figure 2:
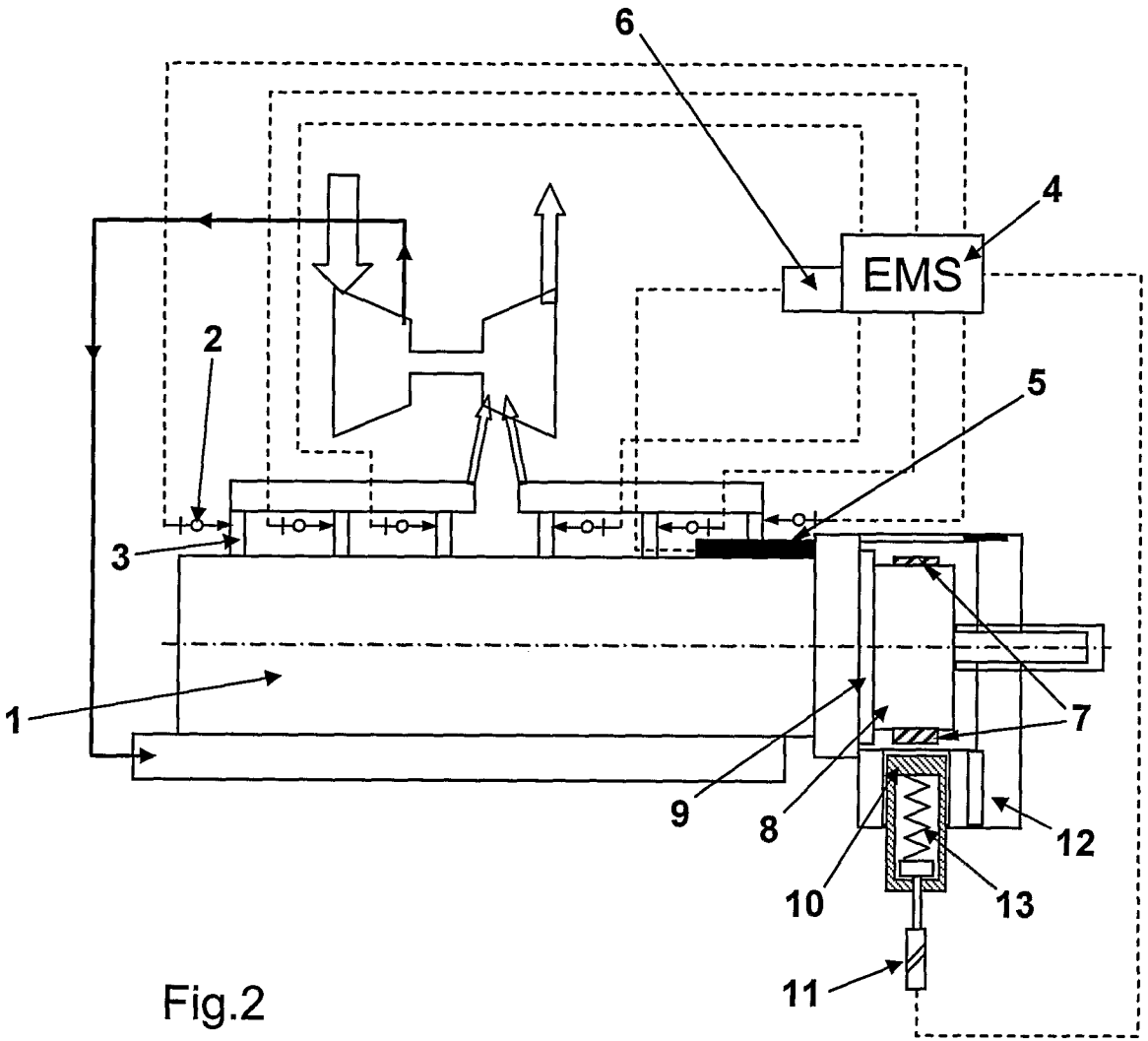
FIG. 2 shows an internal combustion engine according to a second embodiment of the invention.

In another embodiment of the present invention shown in FIG. 2, an additional means for control of the cranking speed in the first cranking mode are included to counteract that unfavourable tendency and even out the cranking speed fluctuations. In this embodiment, during the first cranking mode the EMS 4 engages an engine brake with a crank angle-dependent action.

It is known that the rotational speed fluctuations of the crankshaft are caused by compression and expansion strokes of engine pistons and the status of each stroke is completely defined by the angular position of the crankshaft or the camshaft. That fixed relationship between the angular position of the crankshaft and the status of the strokes is used to define the shape of a cam disk 7 which can be mounted, as shown in FIG. 2, on the clutch housing 8 that is bolted to the engine flywheel 9. A friction brake shoe 10 with its position control mechanism 11 is installed on the transmission housing 12 that is bolted to the engine 1. The EMS controls the extension of the brake shoe towards the cam disk such that, during the first cranking mode, friction forces between the cam disk 7 and the shoe 10 are created at the times when engine pistons tend to be accelerated in the expansion strokes. Thus, crankshaft rotational speed fluctuations are effectively dampened and a higher average rotational speed can be allowed without the risk of reaching fuel ignition temperature in the power cylinders.

It will be appreciated that the complexity of such a crank angle-dependent engine brake as described above can be quite low, because there is no real-time control or tracking functions necessary to achieve the crank angle-dependent application of brake force. The EMS simply controls the extent of protrusion of the brake shoe towards the cam disk, and the crank angle-dependent action is achieved by mechanical means. That protrusion control may in its simplest form be a two-position or an ON/OFF control provided that resilient means 13 is in place and is designed to achieve smooth engagement of the brake shoe 10 with the cam disk 7. Alternatively, if a better control of the average brake force is necessary, the EMS can be easily adapted to control the protrusion of the shoe on either a stepped, continuous, or even real-time basis with a feedback from the engine speed sensors.

By using the engine brake in the first cranking mode, it is possible to reduce rotational speed fluctuations of the engine and at the same time increase its average rotational speed, which will speed up evacuation of the leaked fuel and its vapour from the system and allow the engine to be started earlier.

A further simplification of the system according to the present invention may be achieved by the use of the crank angle-dependent engine brake in lieu of the starter motor controller 6. In such an embodiment, the starter motor is activated in a conventional manner at full electrical power, and the slow cranking speed is achieved by applying the engine brake. This embodiment allows a reduction in the cost of the system as the electric power supply controller is eliminated.

A variation of the design of the crank angle-dependent engine brake can be based on the control of the engagement of the vehicle's transmission clutch 8 while the vehicle is in gear and is secured with the parking brake. The principle of such a design can be similar to that used in the alternative embodiment shown in FIG. 2, but the cam disk 7 can be used to provide either the position information, pilot force or the actual force (for example, via a mechanical or a hydraulic link) that is used to control the mechanism for the clutch engagement. The use of the clutch, transmission and conventional brake system of the vehicle instead of the additional engine brake system that comprises the brake shoe 10, can reduce the cost and complexity of the system.

When the engine is equipped with the crank angle-dependent engine brake, the above-described method of leakage detection and safe start-up of engine will additionally include switching that brake on before or at the time of switching on the first engine cranking mode as per step 2.

Figure 3:
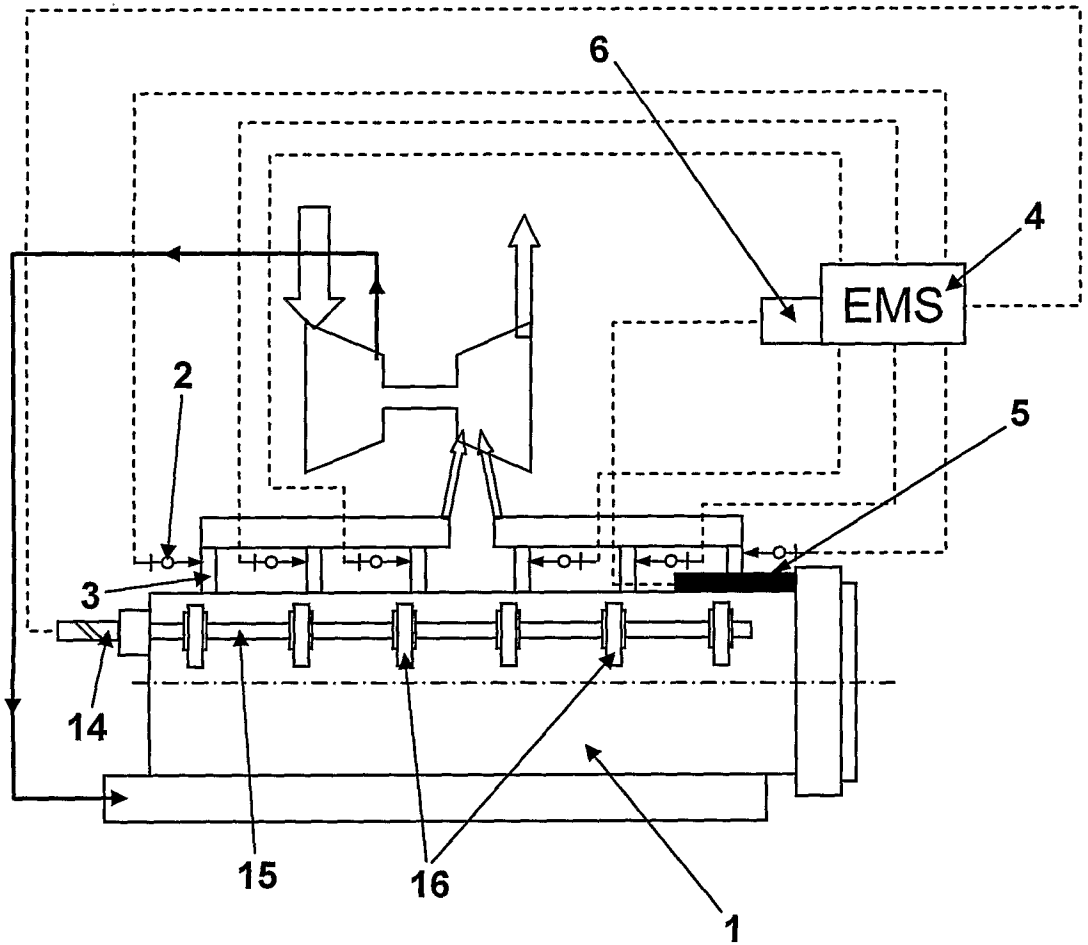
FIG. 3 shows an internal combustion engine according to a third embodiment of the invention.

In another alternative embodiment of the present invention which is illustrated by FIG. 3, the pre-starting mode is achieved by opening communication of the cylinders with their exhaust ports while the engine is still stopped. In this embodiment, evacuation of the leaked fuel from the cylinders is effected by a natural evaporation of the high-volatility fuel. The evaporation can still reduce the temperature around the temperature sensors installed in the exhaust ports, and that can be picked up by the EMS 4, which then determines the duration of the pre-starting mode activation in the same way as described above. The communication of the cylinders with the exhaust ports 3 can be controlled by an additional de-compressing mechanism, comprising or consisting of an actuator 14, linkage 15 and levers 16 that can provide, upon a command from the EMS, a force that opens engine exhaust valves (not shown). When the engine is ready to be started, the mechanism is de-activated and the engine is started in the conventional way.

Another aspect in the improvement of operational safety of engines that use high-volatility fuels such as DME and in which a leakage of the fuel into power cylinders can occur while the engine is stopped, is that due to a relatively low ignition temperature of some of such fuels there is a possibility that the temperature of an element of the exhaust system can be higher than the fuel ignition temperature when the engine is stopped. If then an engine start-up is attempted in such situation and a fuel leak had been present on the stopped engine, the fuel and its vapour displaced from the affected power cylinder during the first cranking mode, may ignite and damage the engine. To prevent this, either the EMS can be programmed to disallow engine starting until a time period has expired, ensuring that the temperature of the surfaces that the fuel may get in contact with is below ignition temperature, or a temperature sensor can be installed in the vicinity of a known engine hot spot and the decision on letting the start-up to proceed can then be taken by the EMS on the basis of that measurement.

The invention is not limited to the above-described embodiments and many modifications are possible within the scope of the following claims. Such modifications may, for example, involve positioning of the cam disk 7 on other engine parts or shafts that are connected to the crankshaft; designing the mechanism for the crank angle-dependent engine brake in a different way to that described; introducing various time delays to ensure that the fuel vapour is removed from the exhaust system before fuel injection is turned on to start up the engine; etc.

The invention claimed is:

1. An internal combustion, compression ignition engine for use with a pressurized low viscosity fuel, the engine comprising an engine power cylinder with its associated exhaust gas flow path, an exhaust valve system for opening fluid communication between the engine power cylinder and the exhaust gas flow path, and an engine management system (EMS), the engine management system being arranged to provide a pre-starting mode in which an open fluid communication between the engine power cylinder and the exhaust gas flow path is established and prevents fuel present inside the engine power cylinder from reaching a fuel ignition temperature for the fuel.

2. An internal combustion engine according to claim 1, comprising means for activating the valve system for opening the fluid communication between the engine power cylinder and the exhaust gas flow path in the pre starting mode.

3. An internal combustion engine according to claim 2, wherein the means for activating the valve system comprises a de-compressing mechanism.

4. An internal combustion engine according to claim 2, wherein the means for activating the valve system comprises a starter motor.

5. An internal combustion engine according to claim 4, wherein the starter motor is connected to a controller arranged to communicate with the EMS for controlling a cranking speed of the engine during the pre-starting mode.

6. An internal combustion engine according to claim 5, wherein the controller is arranged to control a supply of electric power to the starter motor in response to input from the EMS.

7. An internal combustion engine according to claim 1, wherein the EMS is connected to a sensor installed in the exhaust gas flow path for controlling the means for activating the valve system during the pre-starting mode with reference to an output of the sensor.

8. An internal combustion engine according to claim 7, wherein the sensor is a temperature sensor.

9. An internal combustion engine according to claim 1, wherein the engine comprises a plurality of power cylinders and a temperature sensor in an exhaust gas flow path of each of the engine power cylinders, the engine management system being arranged to maintain the pre-starting mode either until differences between temperatures measured by each of the temperature sensors are below a predetermined value, or until a maximum allowed duration is reached.

10. An internal combustion, compression ignition engine for use with a pressurized low viscosity fuel, the engine comprising an engine power cylinder with its associated gas flow path, an exhaust valve system for opening fluid communication between the engine power cylinder and the gas flow path, an engine management system (EMS), the engine management system being arranged to provide a pre-starting mode in which an open fluid communication between the engine power cylinder and the gas flow path is established and prevents fuel present inside the engine power cylinder from reaching a fuel ignition temperature for the fuel, and means for activating the valve system for opening the fluid communication between the engine power cylinder and the gas flow path in the pre-starting mode, wherein the means for activating, the valve system comprises a starter motor, and wherein the EMS is arranged to control means for braking the engine during the pre-starting mode.

11. An internal combustion engine according to claim 10, wherein the means for braking the engine comprises a vehicle transmission with a clutch and a vehicle braking system.

12. An internal combustion engine according to claim 10, wherein the means for braking the engine is arranged to apply a crank angle-dependent braking action.

13. An internal combustion engine according to claim 12, wherein a cam disk is installed on an engine shaft, wherein the profile of the cam surface of the cam disk defines the braking effect of the engine brake.

14. An internal combustion engine according to claim 13, wherein the means for braking the engine comprises a brake shoe which is arranged to engage the cam disk for control of speed fluctuations of a crankshaft of the engine during cranking.

15. An internal combustion engine according to claim 14, wherein the cam disk is installed on the engine crankshaft.

16. An internal combustion engine according to claim 10, wherein the engine comprises a plurality of power cylinders and a temperature sensor in an exhaust gas flow path of each of the engine power cylinders, the engine management system being arranged to maintain the pre-starting mode either until differences between temperatures measured by each of the temperature sensors are below a predetermined value, or until a maximum allowed duration is reached.

17. A method of operating an internal combustion, compression ignition engine for use with a pressurized low viscosity fuel, the engine comprising an engine power cylinder with its associated exhaust gas flow path, an exhaust valve system for opening fluid communication between the engine power cylinder and the exhaust gas flow path, an engine management system (EMS) and a sensor in the exhaust gas flow path of each of the engine power cylinders, comprising the:

measuring of sensor outputs and storing measured data in a memory of the EMS;

activating the valve system in a pre-starting mode that prevents the fuel from reaching a fuel ignition temperature;

comparing new measurement data provided by the sensors during the pre-starting mode with respect to the stored data and with respect to differences in the outputs of individual sensors;

maintaining the pre-starting mode either until measured differences are below a predetermined value, or until a maximum allowed duration is reached.

18. A method according to claim 17, the comprising measuring differences in the outputs of the individual sensors for estimation of injector-to-injector uniformity of fuel delivery.

19. The method as set forth in claim 17, wherein the sensors are temperature sensors.

* * * * *